US005175922A

United States Patent [19]

Gugel et al.

[11] Patent Number: 5,175,922

[45] Date of Patent: Jan. 5, 1993

[54] METHOD FOR THE MANUFACTURE OF AN ARMATURE ASSEMBLY FOR MATRIX PRINT HEADS OF THE HINGED-CLAPPER-ARMATURE CONSTRUCTION

[75] Inventors: Bernd Gugel, Ulm-Einsingen; Johann Stempfle, Pfaffenhofen, both of Fed. Rep. of Germany

[73] Assignee: Mannesmann Aktiengesellschaft, Düsseldorf, Fed. Rep. of Germany

[21] Appl. No.: 387,501

[22] Filed: Jul. 28, 1989

[30] Foreign Application Priority Data

Aug. 1, 1988 [EP] European Pat. Off. ..... 88730171.1

[51] Int. Cl.[5] ..... H01F 7/06

[52] U.S. Cl. ..... 29/602.1; 29/416; 29/622; 29/884; 400/124

[58] Field of Search ..... 29/416, 418, 602.1, 29/884, 622; 335/279; 400/124

[56] References Cited

U.S. PATENT DOCUMENTS 3,624,896 1/1978 Daubeney et al. ..... 29/416 X
3,921,277 11/1975 Tramposch ..... 29/418
4,018,639 4/1977 Staples, Jr. ..... 29/418 X
4,070,752 12/1971 Robinson ..... 29/884
4,631,824 12/1986 King ..... 29/884
4,674,179 6/1987 Gugel et al. ..... 29/884

*Primary Examiner*—Carl E. Hall
*Attorney, Agent, or Firm*—Horst M. Kasper

[57] ABSTRACT

A method for production of an armature device group for matrix print heads of the clapper-armature construction is based on connecting and jointly processing prefabricated parts (1, 2) such that elongated armatures with wide armature arms (4) and narrower armature arms (5) are generated. For further decreasing the production costs and for increasing the precision of the armature coordination, for facilitating mounting and for saving assembly steps, an armature circle (1) is punched out with openings (6). An annular elastic shaped plate (2) of sheet metal is then attached covering the opening (6) and the radially outer and radially inner armature arms (4, 5) are then cut out employing a method such as thermal cutting or, respectively, water-torch cutting, without damaging of the shaped plate (2).

29 Claims, 2 Drawing Sheets

METHOD FOR THE MANUFACTURE OF AN ARMATURE ASSEMBLY FOR MATRIX PRINT HEADS OF THE HINGED-CLAPPER-ARMATURE CONSTRUCTION

BACKGROUND OF THE INVENTION

1. Field of the Invention

The invention relates to a method for the production of an armature device group for matrix print heads of the clapper armature construction, as well to the armature device group itself, where prefabricated parts are machined jointly after their connection by thermal cutting or, respectively, water-torch cutting, whereby, after the cutting, elongated armatures are formed with wide radial outer armature arms, disposed in operating position above a magnet core of an electromagnetic coil, and where narrower radial inner, armature arms are formed connected following to the wider outer arms for actuating the print element.

2. Brief Description of the Background of the Invention Including Prior Art

Such a production method is conducive to and serves for providing an economic production and simultaneously leads to an increase in production precision, i.e. a spatially accurate disposition of armatures relative to each other.

A method according to German Patent DE-C2-3,502,472 concerns a process for the production of an armature device group for a so-called pretensioned magnet system. A permanent magnet is coordinated in a pretensioned magnet system to an electromagnet. The construction and the form of the magnet system is adapted to the electromagnet-permanent magnet system.

The arrangement of the magnet system, in case of matrix print heads of the hinged clapper armature construction in contrast, is distinguished by moving the print element, i.e. the print pin, resting at an armature with a spring force into the rearward rest position. The electromagnet consequently acts against the spring force. According to this, the armatures are furnished with individual springs.

The coordination of an armature with an individual spring to an electromagnetic coil means, however, a cumbersome, expensive mounting, which is associated with the uncertainty of positional deviations. Different drive forces, different path lengths, and different motion distances are, however, frequently the cause for a nonuniform dot print and a lower frequency in matrix print heads of the hinged clapper armature construction.

SUMMARY OF THE INVENTION

1. Purposes of the Invention

It is an object of the invention to lower the construction costs and to increase the accuracy of the coordination of armatures in matrix print heads of the hinged clapper armature construction by improving a production method for an armature device group of the clapper armature construction.

It is another object of the present invention to provide a production method for matrix print heads, where the print heads can be easily mounted and by saving certain conventional mounting steps.

It is yet a further object of the present invention to provide an assembly of armatures for a hinged clapper armature in an armature device group of a matrix print head.

These and other objects and advantages of the present invention will become evident from the description which follows.

2. Brief Description of the Invention

The present invention provides for a method for production of an armature device group for matrix print heads of the clapper-armature construction type and comprises the following steps. A single-piece armature circle is punched with openings disposed in an area between radial outer and radial inner armature arms. A prefabricated, annular, flat, elastic shaped plate is attached to the armature circle and thereby covers in part said openings of the still single-piece armature circle with an annular face. The individual armature arms are cut out by cutting, without severing or disjoining, the flat, elastic shaped plate.

The cutting can be performed by a thermal cutting step or by a water-torch cutting step.

Elongated armatures can be formed after the cutting with wider radial outer armature arms to be disposed in operating position over a magnet core of an electromagnet coil, and including narrower radial inner armature arms following to the outer arms for actuating a print element. The wider radial outer armature arms can be disposed in operating position over a magnet core of an electromagnet coil. A print element can be actuated with the narrower radial inner armature arms. The armature arms can be radial inner armature arms and radial outer armature arms.

Attachment boreholes 13 for print pins 14 can be furnished in a single process step in the armature circle 1.

The radial outer armature arms can be cut free after the attachment of the flat, elastic, annular shaped plate to the armature arms adjoining each other over the circumference with the flat plate.

An armature device group comprises a prepunched armature circle. A shaped plate is attached on the armature circle such that the armature circle and the shaped plate rest in disk shape on top of each other. The shaped plate is formed with a web running over a circle having about half the radius of the outer periphery of the armature circle and having, in each case, radial protrusions. Said protrusions are adapted to the contours of the radial outer armature arm and the radial inner armature arm. Said shaped plate is formed as a single-piece leaf spring. The shaped plate can be attached with welding points on the armature circle. The welding points can be disposed on the inner and the outer periphery of the shaped plate.

In accordance with the present invention, an armature circle with openings disposed between radial outer and radial inner armature arms is stamped or punched. Then, a prefabricated, annular, flat, elastic shaped plate is attached on the still single-piece armature circle with an annular face covering the openings. The individual, radial inner and/or radial outer armature arms are cut out by cutting without severing or disjoining the flat, elastic shaped plate.

The result of this process is a ring, comprised of accurately spaced armatures, produced with the production precision of the production machine, where the armatures can be produced very thin, like a filigree, without the individual armatures having to be collected later, having to be transported, having to be distributed, and without having to be mounted. The thin shaped plate safely maintains the armature at a precise distance during its production and during operation, such that the complete armature device group can be mounted in the shape of its production. For this purpose, the small armature arms are of a particularly low mass, which allows an increase in the print-pin operating frequency. Production and handling of the armatures are improved. The production costs are lowered. The precision of positioning of the armatures relative to each other is very high.

This accuracy and precision of production can be further increased by furnishing attachment boreholes for the print pins to each armature of the circle of armatures in one operating process step. Again, this hole perforating step can be performed prior to the cutting out of the armature arms.

The separation of the individual armature arms can occur as a last operating step by cutting the radial outer armature arms after the attachment of the flat, elastic, annular shaped plate to, in each case, the armature arm adjoining via the circumferential face.

The armature device group, including a prepunched or prestamped armature circle and a shaped plate attached on the armature circle, where the armature circle and the shaped plate are disposed on each other in disk shape, results in new properties, which also have positive effects on the economy of the handling, in particular as far as an interdepartmental and/or factory internal transport and a mounting are concerned. These properties are achieved in that the shaped plate forms a web running along the circumference of the armature circle and, in each case, radial protrusions, which protrusions are adapted to the contours of the radial outer armature arm and of the radial inner armature arm, and which shaped plate is formed as a single-piece leaf spring. The advantage of the webs running along the circumference of the armature circle is that of formation of a hinge such that the armature can thereby in fact be moved independently from each other during operation, but that, however, after production and mounting, they form together with the shaped plate a connected armature device group.

Advantageously, the shaped plate can be attached by way of weld points at the armature circle. Such weld points can be easily applied based on the means employed for the thermal cutting. In addition, it is possible, for example, to employ a laser beam successively to the thermal cutting and to the welding of the weld points.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
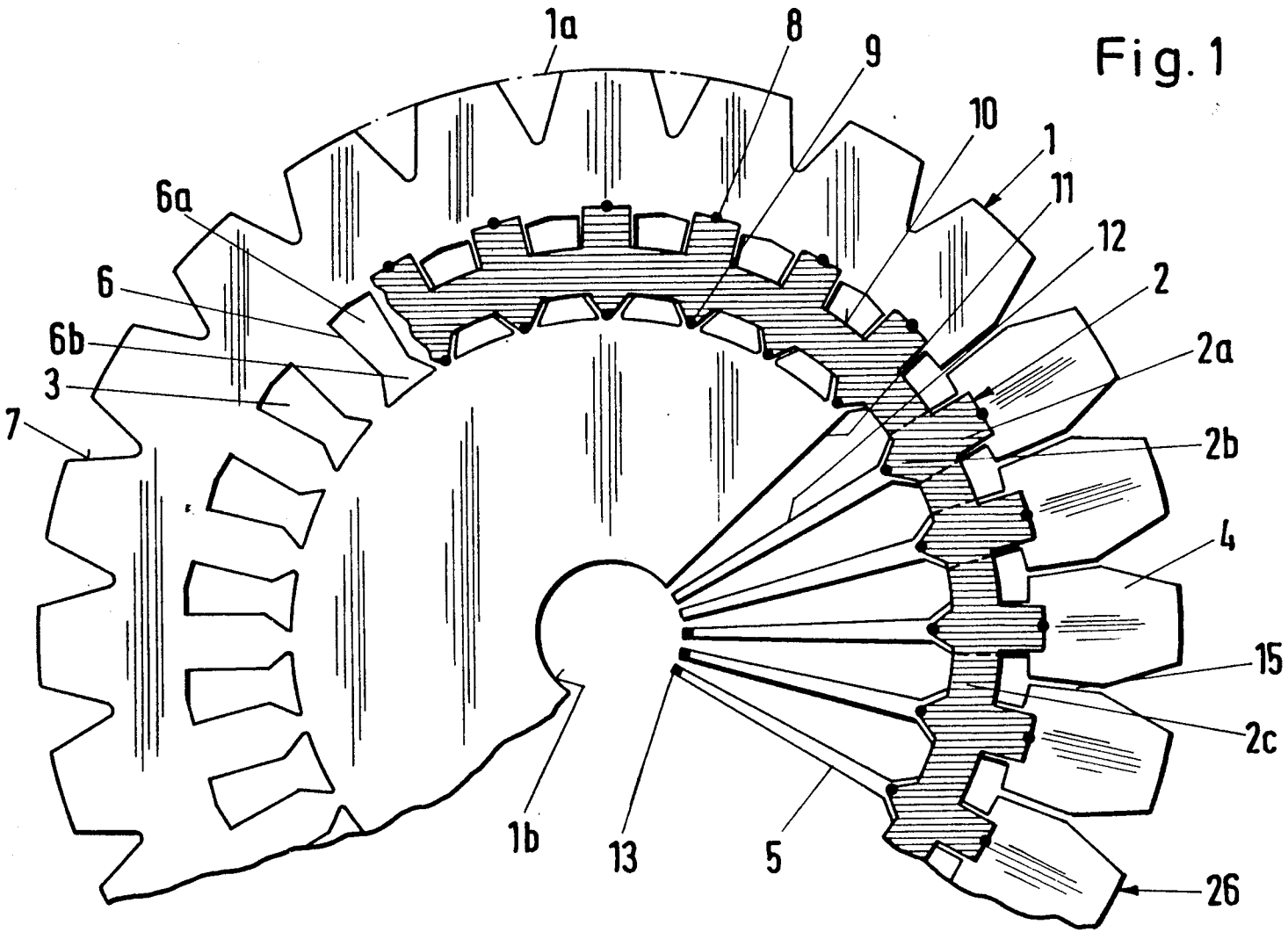
FIG. 1 is a top plan view onto the armature circle and the shaped plate, partly during and partly after the cutting out.

In accordance with the present invention, there is provided a method for production of an armature device group for matrix print heads of the clapper-armature construction type. Prefabricated parts, after their connection, are jointly machined by thermal cutting or, respectively, water-torch cutting. After the cutting, elongated armatures are formed with wider radial outer armature arms disposed in operating position over a magnet core of an electromagnet coil, and including narrower radial inner armature arms following to the outer arms for actuating a print element. The method includes the following process steps: One armature circle is punched with openings disposed in the area of radial outer and radial inner armature arms. A prefabricated, annular, flat, elastic shaped plate is attached, covering the openings of the still single-piece armature circle with an annular face. The individual, radial inner and/or radial outer armature arms are cut by cutting without severing or disjoining the flat, elastic shaped plate.

Attachment boreholes 13 for print pins 14 can be furnished in a single process step in the armature circle 1. The radial outer armature arms 4 can be cut free after the attachment of the flat, elastic, annular shaped plate 2 to the armature arm 4 adjoining in each case over the circumference.

An armature device group comprises a prepunched armature circle 1 and a shaped plate 2 attached on the armature circle 1 by welding. The armature circle 1 and the shaped plate 2 rest in disk shape on top of each other. The shaped plate is formed with a web running over a circle having about half the radius of the outer periphery of the armature circle 1 and having, in each case, radial protrusions. Said protrusions are adapted to the contours of the radial outer armature arm 4 and the radial inner armature arm 5. The shaped plate 2 is formed as a single-piece leaf spring. The shaped plate 2 can be attached with welding points 8, 9 on the armature circle 1.

The armature device group comprises two parts, i.e. the armature circle 1 with the outer diameter 1*a* and a prefabricated, annular, flat, elastic shaped plate 2, made of sheet metal.

The armature circle 1 is punched or stamped out with openings 6 in the region 3 between the prospective radial outer armature arms 4 and the prospective radial inner armature arms 5. In addition, simultaneously, cut-out sections 7 can be punched out, which cut-out sections 7 take into account the radial outer armature arm 4, if these cut-out sections are not cut out during one of the later processing steps.

The prefabricated, annular, flat, elastic shaped plate 2 is placed and attached to the thus punched-out armature circle 1, while this armature circle 1 is still a single piece. For this purpose, the shaped plate 2 includes an outwardly radial extension 2*a*, which in part covers, in each case, the prospective radial outer armature arm 4 and includes an about triangular-shaped protrusion 2*b*, which protrusion 2*b* extends radially inwardly. The outwardly directed extension 2*a* and the inwardly directed triangular protrusion 2*b* are a single piece of a full ring 2*c* and form together the shaped plate 2.

The armature circle 1 can further be punched with a centered, circular opening 1*b*, in case this circular opening 1*b* is not intended to be cut out at a later point.

The shaped plate 2 is attached with welding points 8 and 9, by way of laser beams, such that the annular face 10 in part covers the openings 6. In this case, the radial outer sections 6a and the radial inner sections 6b of the opening 6, respectively, remain open.

Subsequently, the individual, radial inner and/or radial outer armature arms 4 and 5 are cut out in a third processing step by way of laser cutting, spark-discharge erosion machining, or water-torch cutting, such that the armature arms 4 and 5 are generated after the cutting along the cut-out lines 11 and 12.

Figure 2:
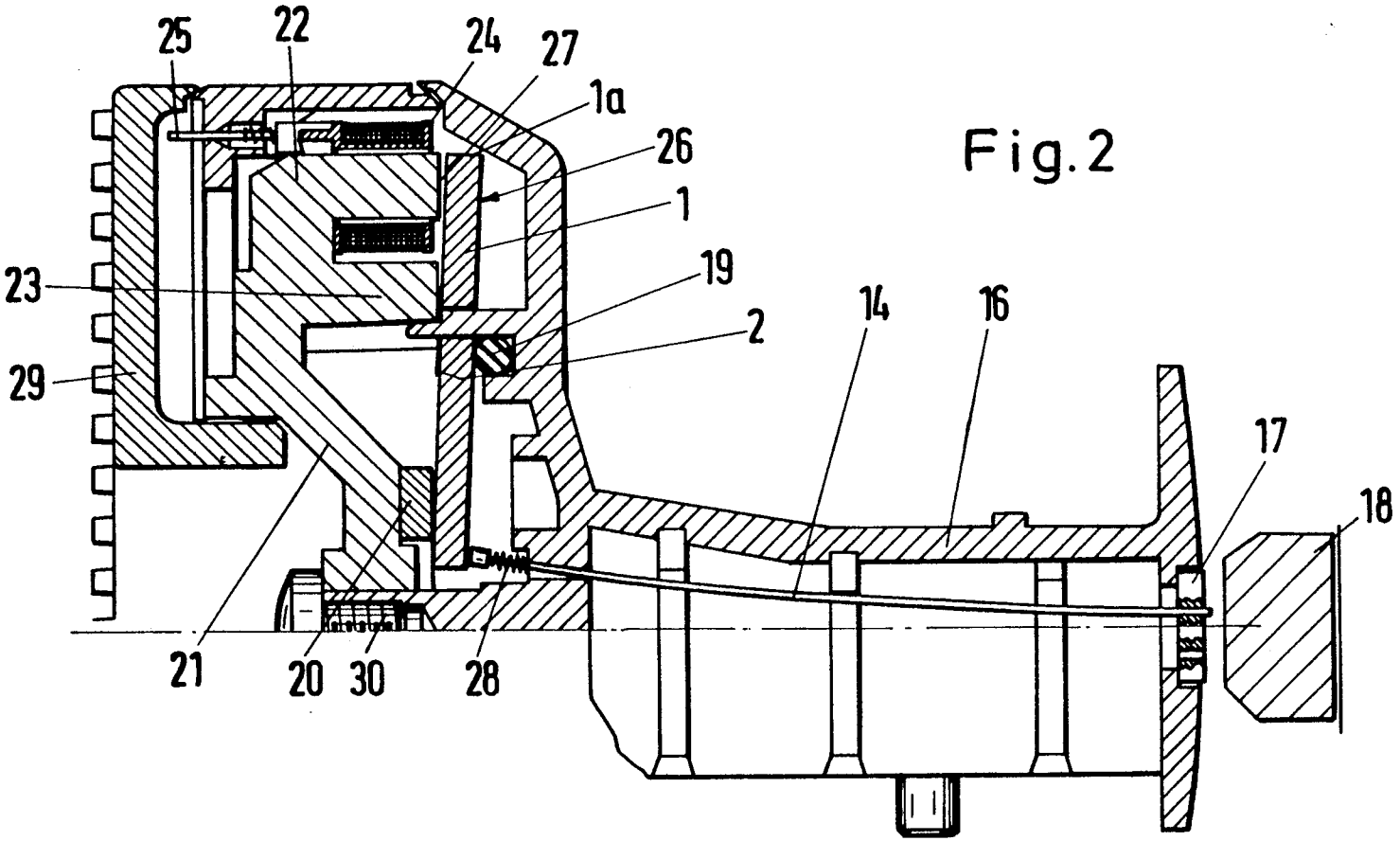
FIG. 2 is a cross-sectional view in longitudinal direction through a matrix print head of the clapper armature construction.

In case the construction of the matrix print head according to FIG. 2 should require attachment boreholes 13 for the print pins 14, then such attachment boreholes 13 can be bored by way of laser beams, or the like, in a single process step also prior to the cutting out of the cut-out lines 11 and 12.

If this has not already occurred during the cutting out along the cut-out lines 11 and 12, the radial outer armature arms 4 can now be cut free along the circumference adjoining each other, successively in each case. In each case, a slot 15 is thereby generated.

In case the full ring 2c is to operate not only as a hinge between two radial outer armature arms 4, but in case additional restoring forces are to be transferred by torsion elements, then it is provided that the shaped plate 2 forms a web, such as for example the ring 2c, running over a circumference, corresponding to an about middle radius, for example as illustrated, of the armature circle 1. In each case, radial protrusions would be provided, which are adapted to the contours of the radial outer armature arm 4 and the radial inner armature arm 5. These protrusions are formed identical or similar to the outwardly directed radial extension 2a or to the triangular protrusion 2b, however, they can be allowed to be of greater length. In each case, the welding points 8 and 9 have to be provided, where the welding points 8 and 9 are disposed at the outermost or, respectively, innermost contour of the shaped plate 2.

The armature device group produced according to the preceding described method is incorporated into a matrix print head as illustrated in FIG. 2. The print pins 14 are supported in a print-pin guide case 16 and the pins are disposed together in a print pin guide 17 in front of a print counter support 18. The print-pin guide case 16 also receives the armature device group, where the armature device group rests against an O-ring 19, on the one hand, and against a damper ring 20, on the other hand. In this case, the damper ring 20 is supported at a coil support 21, which coil support 21 forms the magnet yoke arms 22 and 23. The outer magnet yoke arm 22 carries a corresponding electromagnetic coil 24, which electromagnetic coil 24 is connected by way of a terminal connection 25 to an electric circuit for actuation of the electromagnetic coils 24. The armature device group is disposed as illustrated in a withdrawn or retreat position, i.e., the print pins 14 are in waiting position. In this position, each armature 26 is positioned with a slot distance 27 relative to the front faces of the magnet yoke arms 22 and 23. When current is fed through the electromagnetic coil 24, each armature 26 rests for a short time flat on the front faces of the magnet yoke arms 22 and 23, in order to return immediately subsequently back into the illustrated position. In this case, each armature 26 is supported by a restoring force also present in the shaped plate 2. In addition, springs are coordinated to the print pins 14, as illustrated, for example, compression springs 28. The matrix print head is then closed at its back side with a cooling body 29. A screw 30 connects the print-pin guide case 16 and the coil support 21 to form a single unit.

The number of pins can vary from about 8 to 50, and is preferably from about 9 to 24. The open angle between the two neighboring inner arms or tines as seen from the center of the armature circle can be from about 1 to 5 degrees and is preferably between 2 and 3 degrees. The ratio of the angle of the inner arm versus the angle of the spacing between the arms, as in relation to the center of the armature circle, can be from about 2 to 10 and is preferably between 3 and 5. The outer section of the armature circle is the section which is outside of the weld point between shaped plate and armature circle. The inner part of the armature circle is the section which corresponds to a ring having an inner radius equal to the opening 1b and having an outer radius defined by the inner weld points between the armature circle and the shaped plate. The radial weld distance length is defined as the radial distance between an inner weld point and a corresponding outer weld point used to join the armatures and the shaped plate. Preferably, the width of the web in radial direction can be from 0.3 to 0.7 times the weld length and is preferably from about 0.4 to 0.6 times the weld length. The radius of the shaped plate between two inner weld points on the inside of the shaped plate is preferably by 0.25 to 0.35 times the weld length larger than the radius of the corresponding inner weld points. The angle of the innermost corner of the triangular-shaped protrusions 2b is preferably between 70 and 90 degrees. The width in circumferential direction of the protrusion 2a can be from about 0.8 to 1.2 times the width of the shaped plate in the web area in radial direction. Preferably, the protrusions 2a assume more or less the shape of teeth in a gear wheel. The side edges of the protrusions can extend in radial direction or at an angle of up to 15 degrees deviating from the radial direction such that the angle between the edge of the protrusion and an outer circle of the web area becomes correspondingly decreased. Preferably, the inner weld point and the corresponding outer weld point are disposed on a radius of the armature circle. The diameter of the weld point can be from about 0.1 to 0.3 times the radial width of the full ring 2c in radial direction. The angle of the inner arm 5 relative to the center of the armature circle can be from about 0.1 to 0.3 times the maximum angle covered by the outer armature arm 4 and is preferably from about 0.15 to 0.25 times the maximum angular width of the outer armature arm 4. The length of the inner armature arm, as measured from the weld point, can be preferably from about 1.5 to 3 times the length of the outer armature arm relative to the radial length of the outer arm relative to the corresponding weld point, and is preferably from 1.75 to 2 times the radial length of the outer arm relative to the corresponding weld point. The length of the inner armature arm from the inner weld point can be from about 1.75 to 3 times the weld length is preferably from about 2 to 2.5 times the weld length. The shape of the armature circle in the area of the weld points roughly corresponds to the shape of the shaped plate with the exception that the outer arm extends with a larger width beyond the outer weld point toward the inside by about 0.1 to 0.4 times the radial width of the web section.

The outer armature arms are preferably formed like spades or like hexagons, where the outer arms have a radial directed symmetry axis, where the inner angle at the outer corner is from about 100 to 110 degrees and where the inner angle at the inner corner is from about 90 to 100 degrees. The radial edge of the outer arm can encompass a corner point of said hexagon at a radial position corresponding to 0.4 to 0.6 of the distance of the length of the outer arm relative to the outer circumference of the outer arm in radial direction. The inner angle of the hexagon can be at this point from about 150 to 160 degrees. Preferably, the width of the armature circle is slightly larger in the area of the protrusion of the shaped plate and preferably by about 10 to 20 percent wider than the protrusion. The angle between the narrowing corners of the armature circle in the area of the inner weld point between the shaped plate and the armature circle can be from about 70 to 80 degrees. The weld points are preferably disposed on the inner periphery and on the outer radial periphery of the shaped plate placed on the armature circle. The armature circle is preferably made of a soft magnetic material having substantial strength against bending in a direction perpendicular to the armature circle.

It will be understood that each of the elements described above, or two or more together, may also find a useful application in other types of structures employing hinged clapper arms disposed along a circle and differing from the types described above.

While the invention has been illustrated and described as embodied in the context of a method for the manufacture of an armature assembly for matrix print heads of the hinged clapper armature construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method for production of an armature device for matrix print heads having a clapper-armature comprising punching a single-piece circular armature blank with individual openings disposed in a circular arrangement in an area within the circular armature blank;

attaching a prefabricated, elastic, annular, flat plate to the punched circular armature blank, thereby covering in part said openings of the still single-piece circular armature blank the flat plate;

cutting the armature blank in a radial direction to form armature arms, wherein said cutting is performed without severing or disjoining the prefabricated, elastic, annular flat plate, and wherein the armature blank including armature arms and the prefabricated, elastic, annular flat plate form together an armature device;

disposing a plurality of electromagnets adapted to engage respective armature arms in a casing of a print head; and mounting the armature device in a predetermined relationship to said electromagnets in the casing.

2. The method according to claim 1 further comprising performing the cutting by a thermal cutting step.

3. The method according to claim 1 further comprising performing the cutting by a water-torch cutting step.

4. The method according to claim 1 further comprising forming elongated armatures after the cutting with wider radial outer armature arms to be disposed in operating position over a magnet core of an electromagnet coil, and including narrower radial inner armature arms.

5. The method according to claim 4 further comprising disposing the wider radial outer armature arms in operating position over a magnet core of an electromagnet coil.

6. The method according to claim 1 wherein the armature arms are radial inner armature arms.

7. The method according to claim 1 wherein the armature arms are radial outer armature arms.

8. The method according to claim 1 further comprising furnishing attachment boreholes (13) for print pins (14) in a single process step in the armature circle (1).

9. The method according to claim 1 further comprising cutting the radial outer armature arms free after the attachment of the flat, elastic, annular shaped plate to the armature arms adjoining each other over the circumference with the flat plate.

10. A method for production of an armature assembly for matrix print heads having a clapper-armature, where prefabricated parts, after their connection, are jointly machined by thermal cutting and water-torch cutting, respectively, where after the cutting, elongated armatures are formed with wider radial outer armature arms disposed in operating position over a magnet core of an electromagnet coil, and including narrower radial inner armature arms following to the outer arms for actuating a print element, characterized by the following process steps:

one armature circle is punched with openings disposed in the area within the circular armature blank;

a prefabricated, elastic, annular, flat plate is attached, covering the openings of the still single-piece circular armature blank with an annular face;

cutting the armature blank in a radial direction to form the armature arms, wherein said cutting is performed without severing or disjoining the prefabricated, elastic, annular flat plate, and wherein the armature blank including armature arms and the prefabricated, elastic, annular flat plate form together an armature assembly;

disposing a plurality of electromagnets adapted to engage respective armature arms in a casing of a print head; and mounting the armature assembly in a predetermined relationship to said electromagnets in the casing.

11. The method according to claim 10, wherein attachment boreholes (13) for print pins (14) are furnished in a single process step in the armature circle (1).

12. The method according to claim 10, wherein the radial outer armature arms (4) are cut free after the attachment of the flat, elastic, annular shaped plate (2) to the armature arm (4) adjoining in each case over the circumference.

13. A method for production of an armature assembly for matrix print heads having a clapper-armature comprising punching a single-piece circular armature blank with openings disposed in an area within the circular armature blank;

attaching a prefabricated, elastic, annular, flat plate to the circular armature blank and thereby covering in part said openings of the still single-piece circular armature blank with the flat plate;

cutting the armature blank in a radial direction to form armature arms, wherein said cutting is performed without severing or disjoining the prefabricated, elastic, annular flat plate, and wherein the armature blank including armature arms and the prefabricated, elastic, annular flat plate form together an armature assembly;

disposing a plurality of electromagnets adapted to engage respective armature arms in a casing of a print head; and mounting the armature assembly in a predetermined relationship to said electromagnets in the casing.

14. A method for production of an armature assembly for matrix print heads having clapper-armature comprising:

punching a single-piece circular armature blank with openings disposed in a circular arrangement in an area within the circular armature blank;

attaching a prefabricated, elastic, annular, flat plate to the circular armature blank, thereby covering in part said openings of the still single-piece circular armature blank with an annular face;

mounting the armature device group in a casing for a print head;

cutting the armature blank in a radial direction to form armature arms, wherein said cutting is performed without severing or disjoining the prefabricated, elastic, annular flat plate, and wherein the armature blank including armature arms and the prefabricated, elastic, annular flat plate form together an armature assembly;

disposing a plurality of electromagnets adapted to engage respective armature arms in a casing of a print head; and mounting the armature assembly in a predetermined relationship to said electromagnets in the casing.

15. The method according to claim 14 further comprising:

performing the cutting by a thermal cutting step.

16. The method according to claim 14 further comprising:

performing the cutting by a water-torch cutting step.

17. The method according to claim 14 further comprising:

forming elongated armatures after the cutting with wider radial outer armature arms to be disposed in operating position over a magnet core of an electromagnet coil, and including narrower radial inner armature arms.

18. The method according to claim 17 further comprising:

disposing the wider radial outer armature arms in operating position over a magnet core of an electromagnet coil.

19. The method according to claim 14 wherein the armature arms are radial inner armature arms.

20. The method according to claim 14 wherein the armature arms are radial outer armature arms.

21. The method according to claim 14 further comprising:

furnishing attachment boreholes (13) for print pins (14) in a single process step in the armature circle (1).

22. The method according to claim 14 further comprising:

cutting the radial outer armature arms free after the attachment of the flat, elastic, annular shaped plate to the armature arms adjoining each other over the circumference with the flat plate.

23. The method according to claim 14 further comprising:

attaching the shaped plate with welding points by way of laser beams, such that the annular face in part covers the openings and wherein radial outer sections and radial inner sections of the opening remain open.

24. The method according to claim 23 further comprising:

cutting individual, radial inner and radial outer armature arms and out subsequently, in a third processing step by way of laser cutting such that the armature arms and are generated after the cutting along the respective cut-out lines.

25. The method according to claim 23 further comprising:

cutting individual, radial inner and radial outer armature arms and out subsequently, in a third processing step by way spark-discharge erosion machining such that the armature arms and are generated after the cutting along the respective cut-out lines.

26. The method according to claim 23 further comprising:

cutting individual, radial inner and radial outer armature arms out subsequently in a third processing step by way of water-torch cutting such that the armature arms and are generated after the cutting along the respective cut-out lines.

27. The method according to claim 14 further comprising:

boring attachment boreholes for the print pins by way of laser beams prior to the cutting out of the respective cut-out lines in a single process step for constructing of a matrix print head;

cutting radial outer armature arms successively free along the circumference adjoining each other and generating a slot thereby; transferring additional restoring forces with torsion elements by providing that the shaped plate forms a web shaped as a full ring running over a circumference corresponding to an about middle radius, wherein the web is to operate not only as a hinge between two radial outer armature arms;

providing radial protrusions adapted to the contours of the radial outer armature arm and the radial inner armature arm, wherein these protrusions are formed identical or similar to the outwardly directed radial extension but are of greater length; furnishing welding points disposed at an outermost contour and at an innermost contour of the shaped plate.

28. The method according to claim 14 further comprising:

incorporating the armature device group produced into a matrix print head with the print pins supported in a print-pin guide case and disposing the pins together in a print pin guide in front of a print counter support; placing the armature device group into the print-pin guide case;

positioning the armature device group resting against an O-ring and against a damper ring, wherein the damper ring is supported at a coil support, wherein the coil support forms the magnet yoke arms, wherein the outer magnet yoke arm carries a corresponding electromagnetic coil;

connecting the electromagnetic coil to an electric circuit by way of a terminal connection for actuation of the electromagnetic coils;

supporting each armature by a restoring force also present in the shaped plate;

engaging the print pins with the force of respective springs;

closing the matrix print head at its back side by positioning a cooling body; connecting the print-pin guide case and the coil support with a screw to form a single unit.

29. The method according to claim 15 further comprising:

forming elongated armatures after the cutting with wider radial outer armature arms to be disposed in operating position over a magnet core of an electromagnet coil, and including narrower radial inner armature arms following to the outer arms for actuating a print element;

disposing the wider radial outer armature arms in operating position over a magnet core of an electromagnet coil;

actuating a print element with the narrower radial inner armature arms, wherein the armature arms are radial inner armature arms;

furnishing attachment boreholes for print pins in a single process step in the armature circle;

cutting the radial outer armature arms free after the attachment of the flat, elastic, annular shaped plate to the armature arms adjoining each other over the circumference with the flat plate.

* * * * *